US005823015A

United States Patent [19]

Shibata

[11] Patent Number: 5,823,015

[45] Date of Patent: Oct. 20, 1998

[54] PIEZOELECTRIC NEEDLE SELECTION DEVICE FOR KNITTING MACHINES

[75] Inventor: Takao Shibata, Osaka, Japan

[73] Assignee: Precision Fukuhara Works, Ltd., Japan

[21] Appl. No.: 806,224

[22] Filed: Feb. 24, 1997

[30] Foreign Application Priority Data

Mar. 19, 1996 [JP] Japan ..... 8-090435

[51] Int. Cl.[6] ..... D04B 15/78

[52] U.S. Cl. ..... 66/218; 66/205

[58] Field of Search ..... 66/218, 219, 220, 66/221, 216, 217, 222, 205, 204, 206, 207, 215; 310/311, 314, 316, 317, 319, 330, 331, 332, 368; 347/68, 71, 72

[56] References Cited

U.S. PATENT DOCUMENTS

| | | | |
|---|---|---|---|
| 4,481,793 | 11/1984 | Cuche et al. . | |
| 4,604,877 | 8/1986 | Sawazaki et al. . | |
| 5,027,619 | 7/1991 | Saito . | |
| 5,042,274 | 8/1991 | Maruyama et al. | 66/218 |
| 5,390,512 | 2/1995 | Mista | 66/218 |
| 5,426,455 | 6/1995 | Williamson et al. | 310/317 |
| 5,462,097 | 10/1995 | Skalka | 66/218 |
| 5,666,999 | 9/1997 | Dewispelanre et al. | 66/218 |

FOREIGN PATENT DOCUMENTS

| | | |
|---|---|---|
| 0 210 790 | 2/1987 | European Pat. Off. . |
| 0 335 099 | 10/1989 | European Pat. Off. . |
| 2 121 836 | 1/1984 | United Kingdom . |

*Primary Examiner*—C. D. Crowder
*Assistant Examiner*—Larry D. Worrell, Jr.
*Attorney, Agent, or Firm*—Bell Seltzer Intellectual Property Law Group of Alston & Bird LLP

[57] ABSTRACT

A knitting machine and needle selection mechanism is provided including a piezoelectric body movable between upper, lower and neutral positions corresponding to knit, tuck and welt positions of the knitting needles, a first driving circuit for displacing the piezoelectric body upwardly, a second driving circuit for displacing the piezoelectric body downardly, a third driving circuit for displacing the piezoelectric body to the neutral position, and a control device for controlling the driving circuits in accordance with a pre-set program.

21 Claims, 9 Drawing Sheets

| | TRANSISTOR CIRCUIT | | | | | |
|---|---|---|---|---|---|---|
| | $T_1$ | $T_2$ | $T_3$ | $T_4$ | $T_5, T_5$ | |
| DOWNWARD MOTION | 1 | 0 | 0 | 0 | 1 | |
| UPWARD MOTION | 0 | 1 | 0 | 0 | 1 | |
| NEUTRAL CONDITION | 0 | 0 | 1 | 0 | 0 | ↕ HIGH SPEED SWITCH |
| | 0 | 0 | 0 | 1 | 0 | |

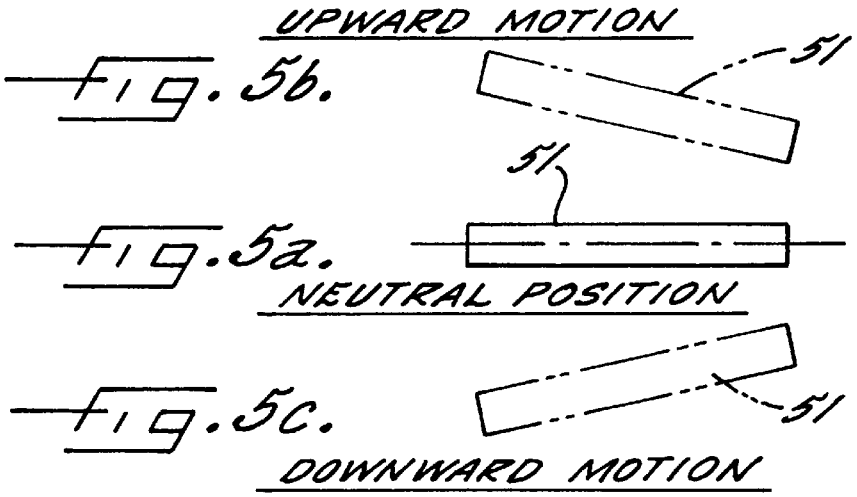
Fig. 5b.
Fig. 5a.
Fig. 5c.
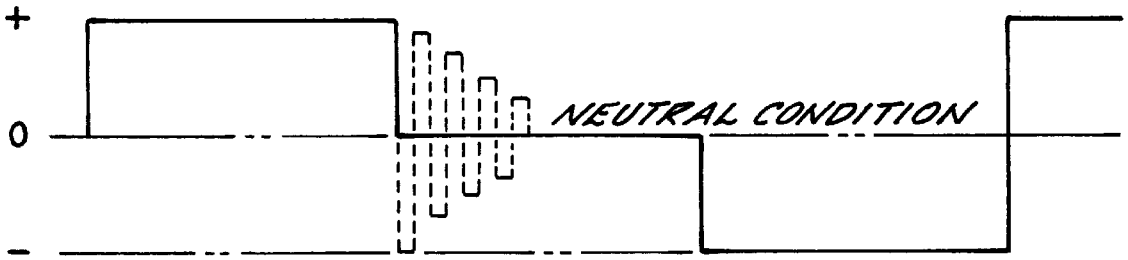
Fig. 6.

PIEZOELECTRIC NEEDLE SELECTION DEVICE FOR KNITTING MACHINES

FIELD OF THE INVENTION

The present invention relates to knitting machines and more particularly to a needle selection device for knitting machines.

BACKGROUND OF THE INVENTION

It is a common practice to provide knitting machines with jacquard pattern devices for knitting various patterns in knit fabrics. There are several different kinds of such jacquard pattern devices with several different kinds of needle selection mechanisms, such as pattern wheels, selection sliders, pattern drums and electronic pattern devices. The present invention relates to an improved electronic pattern device and more specifically to an improved piezoelectric pattern device for knitting machines.

It is known to use a piezoelectric device to control needle selection members of a knitting pattern mechanism. A typical such piezoelectric pattern mechanism is disclosed in Japanese Publication No. 94169 of 1994. This pattern mechanism includes a piezoelectric body having a piezoelectric element, which moves upwardly and downwardly upon application of a voltage thereto. The front end of the piezoelectric body is linked to a movably mounted finger and the piezoelectric body and the finger are arranged in a straight line. The rear end of the piezoelectric body is supported within a groove in a supporting housing and the medial portion of the piezoelectric body is held by a rotating member rotatably mounted on the supporting housing.

In jacquard knitting, the needles move between three operating positions, i.e. knit, tuck and welt positions. Heretofore, to achieve such movement to these three operating positions, the piezoelectric pattern mechanisms required that the fingers be divided into left and right rows, with one row of fingers for selecting those needles to be moved to the welt position and the other row of fingers for selecting those needles to be moved to the tuck position. If one row has eight fingers, for example, the other row also must have eight fingers, resulting in two rows with a total of sixteen fingers arranged in a zigzag pattern.

The large number of fingers required creates significant problems because the number of piezoelectric bodies, and the number of other components and wiring, increase proportionately to the number of fingers. In addition, if the two rows of fingers are arranged on the same horizontal level, as they most often are, the piezoelectric bodies of both rows must have the same capacity, inevitably requiring a large pattern mechanism.

SUMMARY OF THE INVENTION

With the foregoing in mind, it is an object of the present invention to provide a piezoelectric pattern mechanism for knitting machines which overcomes and obviates the problems, disadvantages and deficiencies heretofore encountered with prior piezoelectric pattern mechanisms.

The present invention achieves this object by providing a piezoelectric pattern mechanism in which each piezoelectric body is capable of three operational displacements, which may correspond to the knit, tuck and welt positions of knitting needles. Correspondingly, the piezoelectric pattern mechanism requires only a single row of fingers, each of which is capable of selecting any one of the three operating positions of the knitting needles.

More specifically, the piezoelectric pattern mechanism of the present invention includes a first driving means which causes the piezoelectric body to displace upwardly, a second driving means which causes the piezoelectric body to displace downwardly, and a third driving means for causing the piezoelectric body to displace to the neutral position. Preferably, the piezoelectric pattern mechanism is combined with a needle selection mechanism of a knitting machine in which individual needles are selected by selector jacks which in turn operate spring jacks. Such selector jacks and spring jacks are disclosed in U.S. Pat. No. 4,604,877, issued Aug. 12, 1986, and assigned to the assignee of this application, and incorporated herein by reference.

BRIEF DESCRIPTION OF THE DRAWINGS

Some of the objects and advantages of the present invention having been stated, others will appear as the description proceeds when considered in conjunction with the accompanying schematic drawings, in which:

FIGS. 5*a*, 5*b* and 5*c* are schematic views of the three displaced positions of the piezoelectric body of FIG. 1;

FIG. 6 is a schematic view of an output signal diagram of the piezoelectric body of FIG. 1;

DETAILED DESCRIPTION OF THE PREFERRED EMBODIMENTS

Figure 7:
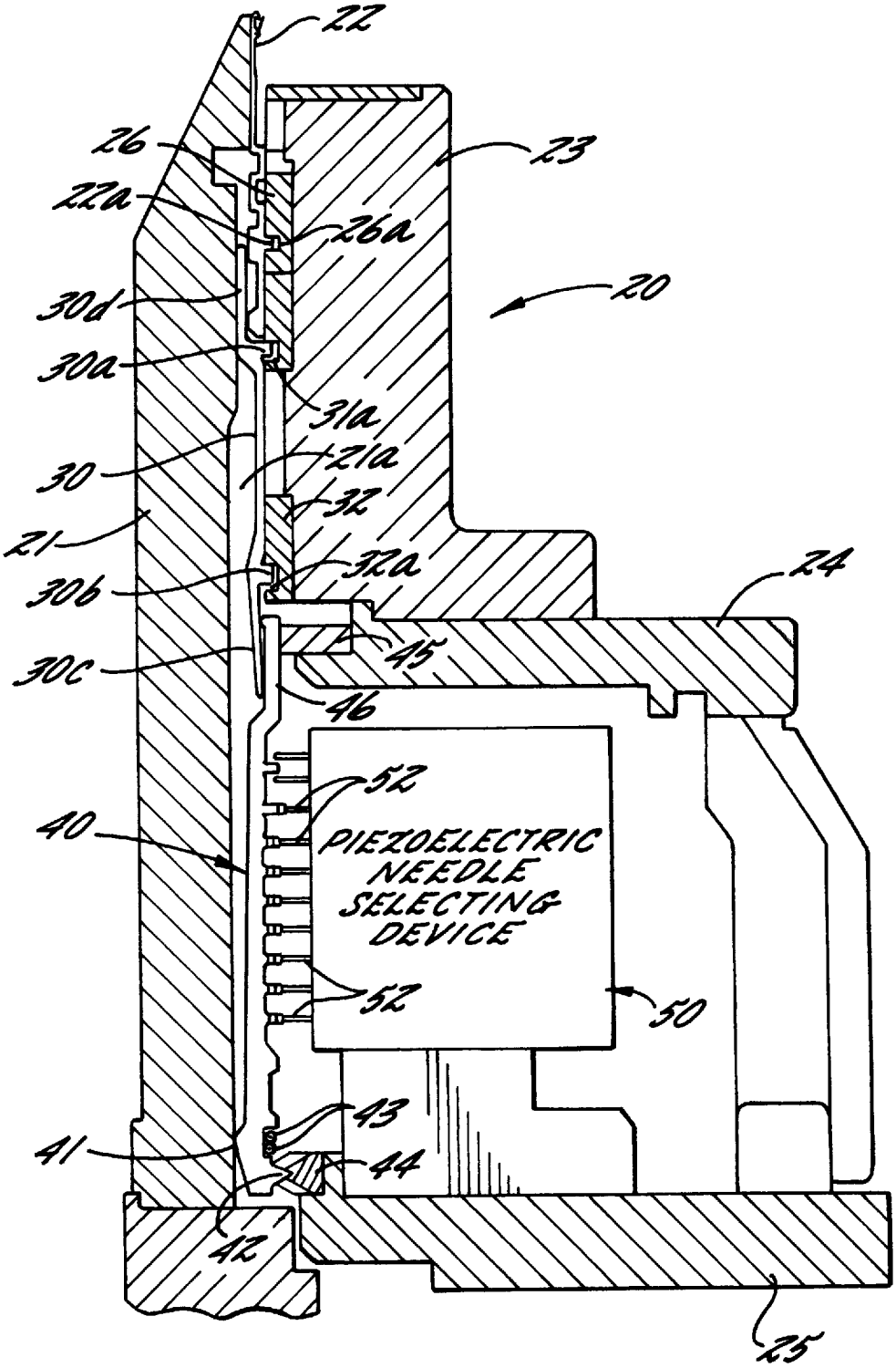
FIG. 7 is a fragmentary, vertical sectional view of a knitting machine incorporating the piezoelectric needle selecting device of the present invention.

Referring now more particularly to the drawings and specifically to FIG. 7, there is illustrated therein a circular knitting machine, generally indicated at 20, incorporating the present invention. Knitting machine 20 includes a needle cylinder 21 having a multiplicity of grooves 21*a* in the outer periphery thereof. In each groove 21*a*, a knitting needle 22 is slidably mounted for vertical movement between three operation positions, i.e. knit, tuck and welt positions.

Knitting machine 20 further includes a cam supporting block 23 which is carried by an upper cam ring 24. Upper cam ring 24 is in turn supported on a lower cam ring 25.

A stitch cam 26 is supported on the inner face of cam block 23 and includes a cam race 26*a*. Cam race 26*a* receives an operating butt 22*a* of needle 22 to move needle 22 upwardly and downwardly in accordance with a predetermined pattern.

A spring jack 30 is disposed in each groove 21*a* of the needle cylinder 21 below each needle 22. Spring jack 30 is substantially identical to the spring jack described in U.S. patent application Ser. No. 08/587,100, filed Jan. 11, 1996, entitled "Circular Knitting Machine With Improved Needle Selection Mechanism," now U.S. Pat. No. 5,647,230, and assigned to the assignee of this application, which is incorporated herein by reference. Accordingly, spring jack 30 will not be described in detail herein except as is necessary for an understanding of the operation thereof.

Spring jack 30 includes a raising butt 30*a*, a lowering butt 30*b* and a lower portion or tail 30*c*. Spring jack 30 also includes an offset upper portion 30*d*, which overlaps the lower end of needle 22 and defines with butt 30*a* a shoulder for contacting the lower end of needle 22. Cam block 23 carries a raising cam 31 having a cam race 31*a* cooperating with butt 30*a* and a lowering cam 32 having a cam race 32*a* cooperating with lowering butt 30*b*.

A selector jack, generally indicated at 40, is mounted in each groove 21*a* of cylinder 21 beneath spring jack 30. The upper end portion 40*a* of the selector jack overlaps the lower portion or tail 30*a* of spring jack 30. Selector jack 40 is also described substantially in the co-pending application incorporated herein by reference (U.S. Pat. No. 5,647,230).

Selector jack 40 has a first pivot portion 41 which contacts the bottom of the groove 21*a* and a V-shaped projection 42 at the lower end thereof. A pair of coil girdle springs 43 biases the lower portion of selector jack 40 toward the bottom of the groove 21*a*, while permitting limited upward and downward movement of the selector jack 40 in the groove 21*a*. A stop plate 45 is mounted on upper cam ring 24 and limits the outward movement of the selector jack 40 to maintain the upper end portion 46 of selector jack 40 in position and in contact with the tail 30*c* of spring jack 30.

Figure 8:
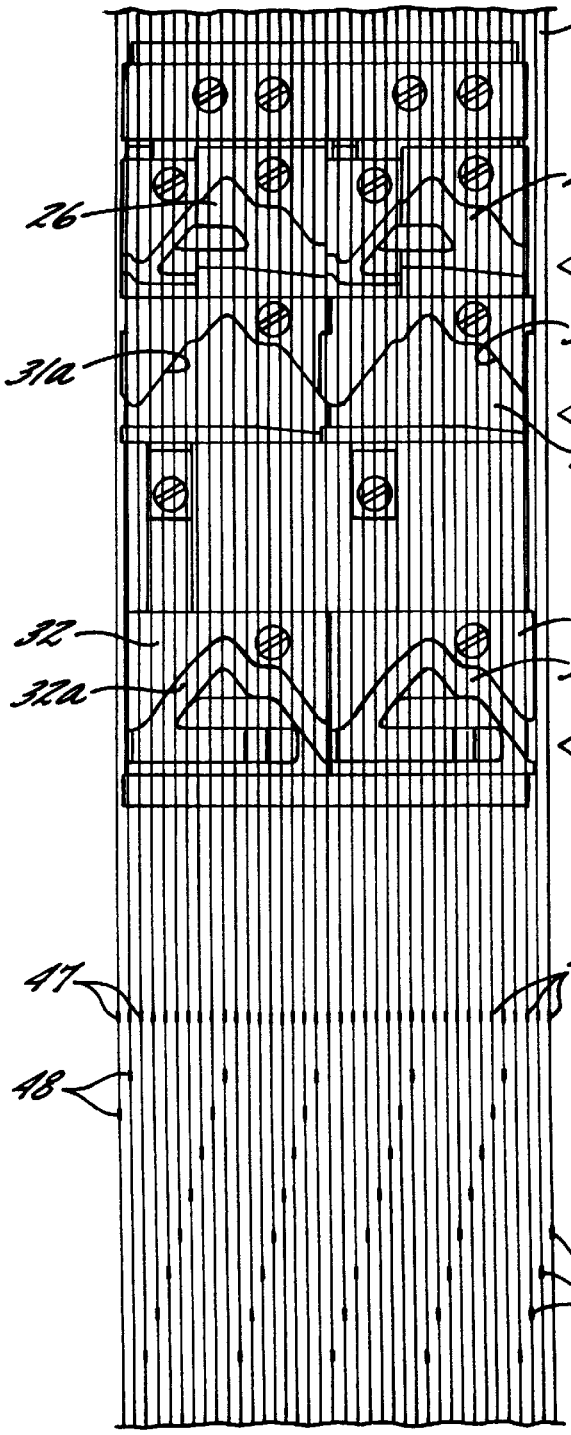
FIG. 8 is an enlarged, fragmentary, schematic view of a cam arrangement of the knitting machine of FIG. 7.
Figure 9:
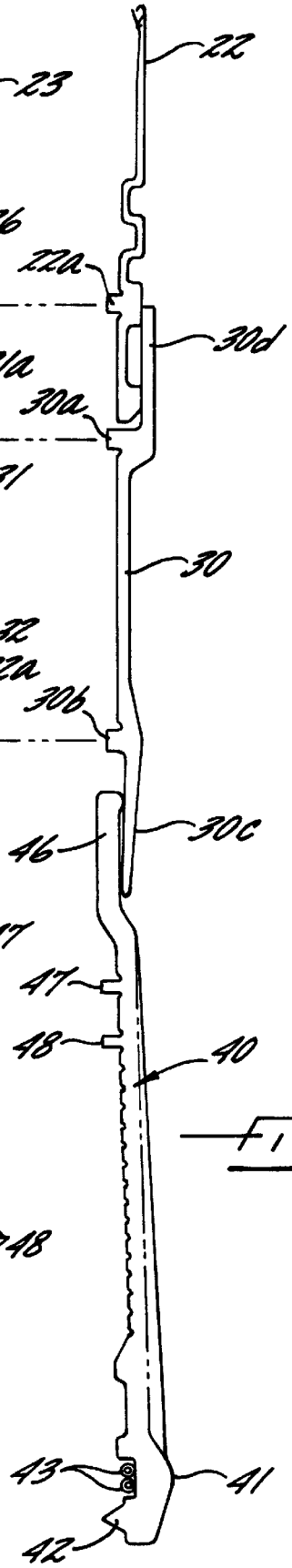
FIG. 9 is an enlarged, fragmentary elevational view of a knitting needle, spring jack and selector jack of the knitting machine of FIG. 7.

Selector jack 40 includes a master butt 47 and a pattern butt 48 below the master butt 47 (FIG. 9). Master butts 47 are respectively at the same level from selector jack to selector jack, while pattern butts 48 on adjacent selector jacks form a row of butts arranged diagonally and with a clearance with each other (FIG. 8).

If desired, the selector jacks 40 may be formed of a relatively thin or narrow elastic or flexible member so as to alleviate the shock that is generated during operation of the knitting machine 20.

The lower cam ring 25 supports a selector jack supporting member 44 for receipt of the V-shaped projection 42 of selector jack 40. Selector jack supporting member 44 preferably has a V-shaped groove 44*a* therein (FIG. 10) to receive the V-shaped projection 42. V-shaped groove 44*a* and V-shaped projection 42 thusly maintain the selector jack 40 at a certain level in normal operation. If desired, supporting member 44 may be provided with an upper sloping surface 44*b* and a lower sloping surface 44*c* to stabilize better the position of the selector jack 40 which has been moved up or down in a manner to be presently described.

Figure 1:
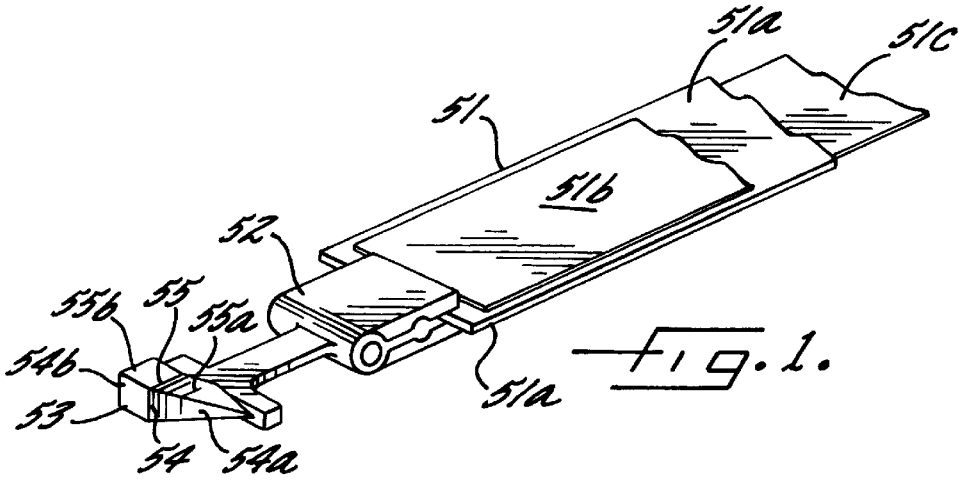
FIG. 1 is a partial perspective view of a piezoelectric body connected to a first type of finger incorporating the features of the present invention.

A piezoelectric needle selecting device, generally indicated at 50 (FIG. 7) is carried by lower cam ring 25 adjacent the path of travel of the selector jacks 40 as they travel with cylinder 21 as it rotates. Piezoelectric needle selecting device 50 includes a plurality of piezoelectric bodies 51 (FIG. 1). The piezoelectric bodies 51 are identical and, therefore, only one will be described. The piezoelectric body 51 (FIG. 1) includes a plate member 51*a* having piezoelectric elements 51*b* and 51*c* attached to opposite sides thereof. These piezoelectric elements may be, for example, a bimorph-type ceramic actuator.

A finger 52 is coupled to the outer end of the plate member 51*a* of piezoelectric body 51 in a movable manner. Finger 52 carries an actuating head, generally indicated at 53, at its outer end for selective engagement with pattern butt 48 of selector jack 40. Each actuating head 53 includes a front end face 54 having an inwardly sloping surface 54*a* and a vertical surface 54*b* downstream of inwardly sloping surface 54*a*. Actuating head 53 also includes an upper face 55 having an upwardly sloping surface 55*a* and an upper horizontal surface 55*b*. Actuating head 53 has a comparable lower face 56 with a downwardly sloping surface 56*a* and a horizontal surface 56*b* downstream thereof.

Figure 15A:
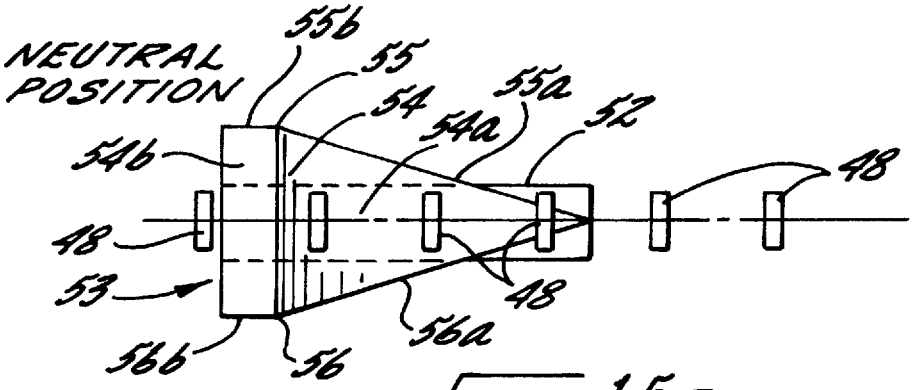
FIGS. 15*a*, 15*b* and 15*c* are schematic views illustrating the operation of the first type of finger of the present invention.
Figure 15B:
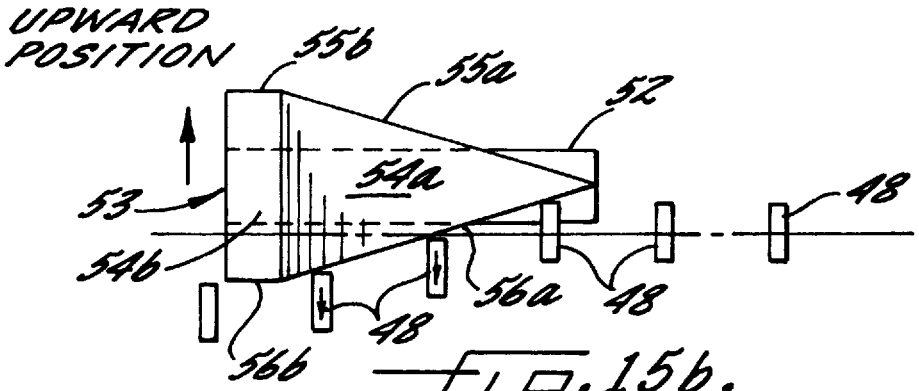
Figure 15C:
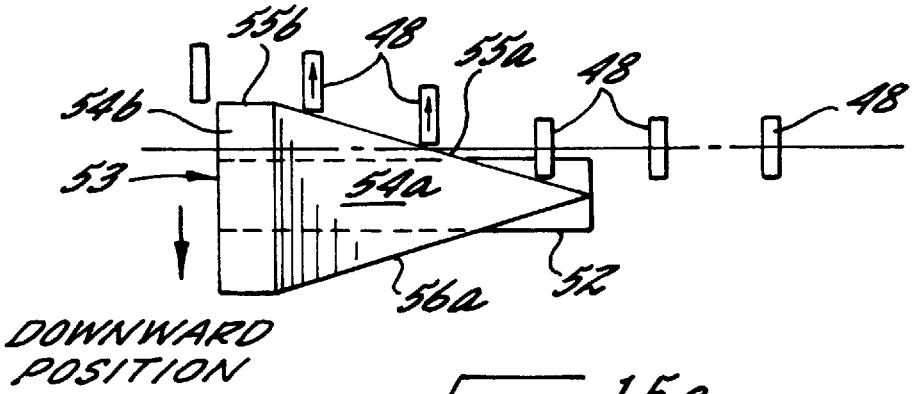
Figure 16A:
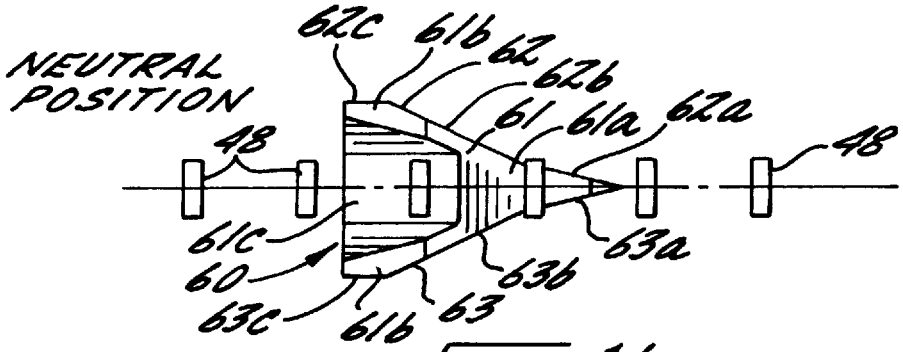
FIGS. 16*a*, 16*b* and 16*c* are schematic views similar to FIGS. 15*a*, 15*b* and 15*c* illustrating the operation of the second type of finger of the present invention.
Figure 16B:
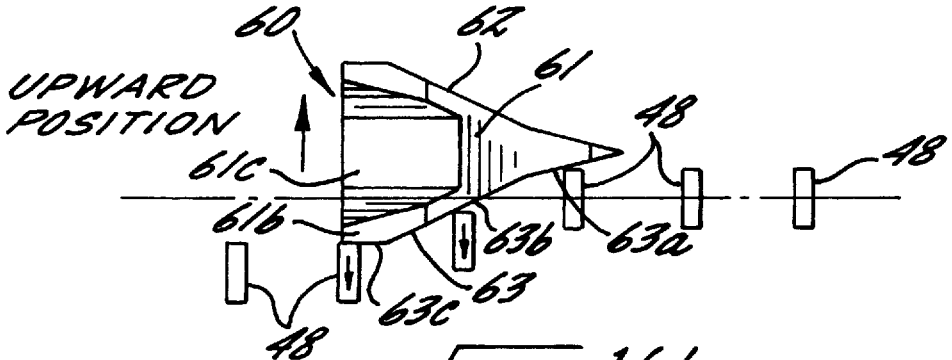
Figure 16C:
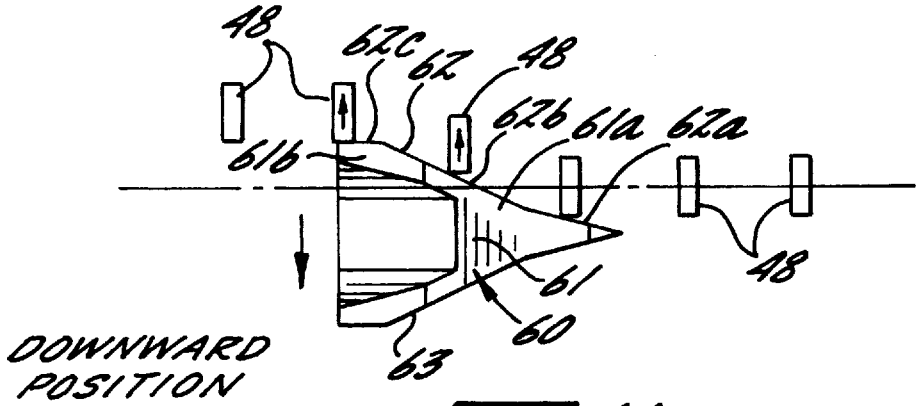

Depending on which of the three operational positions which the piezoelectric body 51 occupies, the pattern butt 40 of a selector jack 40 will contact one of these three faces 54, 55 or 56 and the selector jack 40 will thus be moved inwardly if face 54 is contacted, upwardly if face 55 is contacted or downwardly if face 56 is contacted. A cancelling cam 57 is provided in the path of the master butts 47 to ensure that each selector jack 40 is properly positioned for the piezoelectric needle selecting device 50 and the actuating head 53 (FIGS. 15*a*, 15*b* and 15*c*).

Referring to FIGS. 11, 16*a*, 16*b* and 16*c*, there is illustrated another embodiment of an actuating head 60 carried by the outer end of the finger 52'. Actuating head 60 has a front face 61 having an inwardly sloping surface 61*a*, a bifurcated vertical surface 61*b* and an outwardly sloping surface 61*c* between the bifurcations of vertical surface 61*b*. Actuating head 60 also includes an upper face 62 having a first upwardly sloping surface 62*a*, a second upwardly sloping surface 62*b* downstream of the first upwardly sloping surface 62*a* and a horizontal surface 62*c*. Actuating head 60 has a corresponding lower face 63 having a first downwardly sloping surface 63*a*, a second downwardly sloping surface 63*b* and a horizontal surface 63*c*.

When finger 52' is in the neutral operating position, actuating head 60 contacts pattern butt 48 of selector jack 40 and pattern butt 48 moves along inwardly sloping surface 61*a* which pushes the selector jack 40 inwardly. Butt 48 next contacts outwardly sloping surface 61*c* which gradually returns the selector jack 40 and spring jack 30 to their original positions while alleviating any shock which may be caused when butt 30*b* of spring jack 30 contacts raising cam 24.

When finger 52' is either raised or lowered, butt 48 moves along the surface 62 or 63 and selector jack 40 is raised or lowered. The first sloping surface 62*a* or 63*a* moves the selector jack 40 upwardly or downwardly to the first step and the second sloping surface 62*b* or 63*b* moves the selector jack 40 upwardly or downwardly to the second step. The horizontal length of the second sloping surface 62*b* or 63*b* may be relatively short, which is effective for fine gauge knit fabrics which have a limited needle-selecting range. Preferably, the upward or downward movement of the selector jacks 40 is assisted by the sloping surface 44*b* or 44*a*, respectively, of selector jack supporting member 44.

Figures 10, 11:
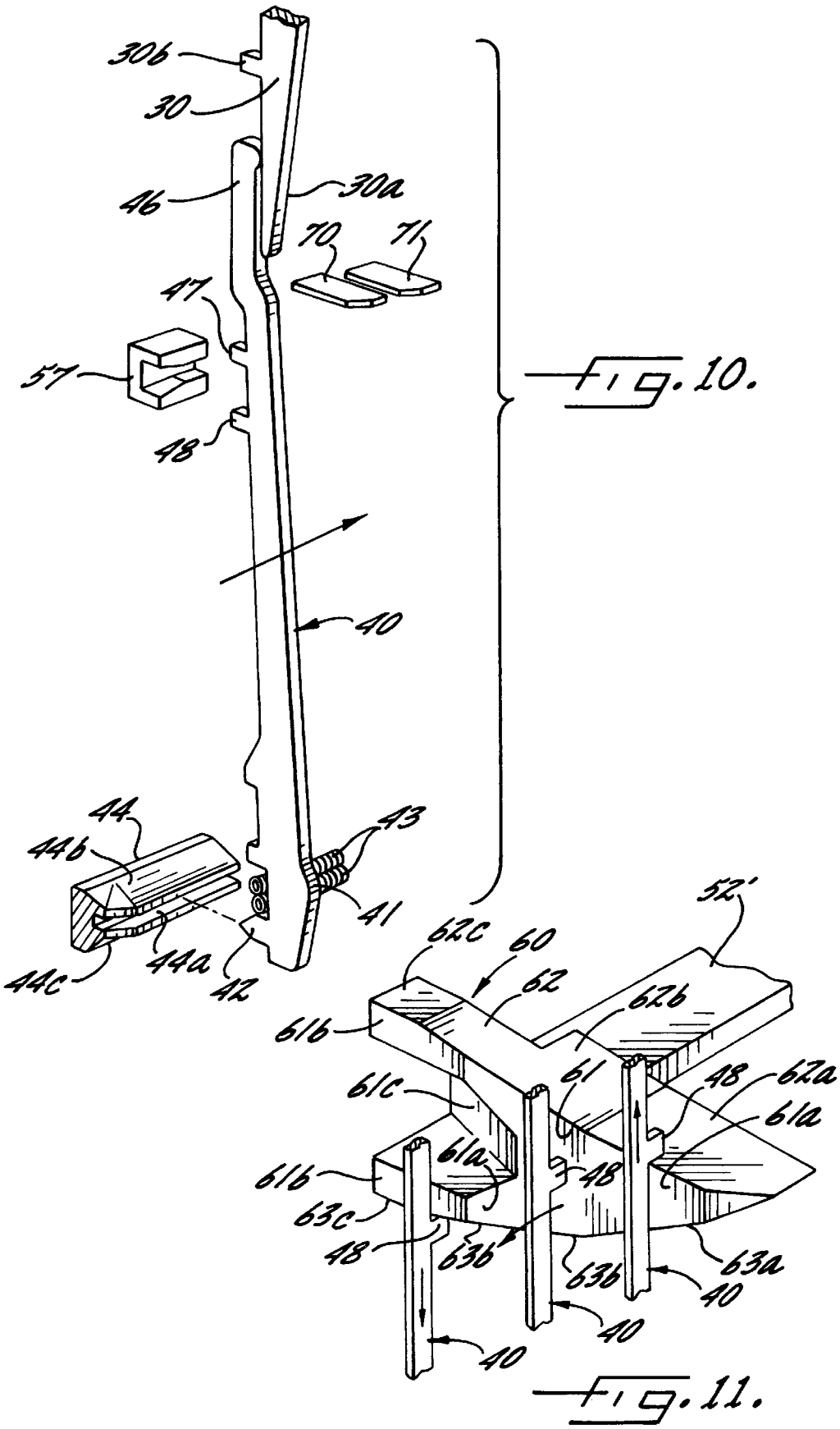
FIG. 10 is an enlarged, fragmentary perspective view of the selector jack, spring jack, cancelling cam, selector jack raising cam and selector jack welt and tuck cams of the knitting machine of FIG. 7.
FIG. 11 is an enlarged, fragmentary perspective view of a second type of finger operated by the piezoelectric body of the present invention.
Figure 12:
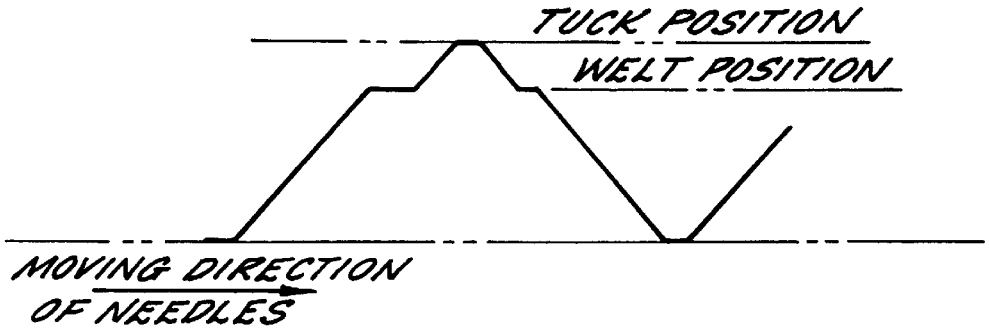
FIG. 12 is a schematic view of a needle-motion diagram illustrating the three operational positions of the needle.
Figure 13:
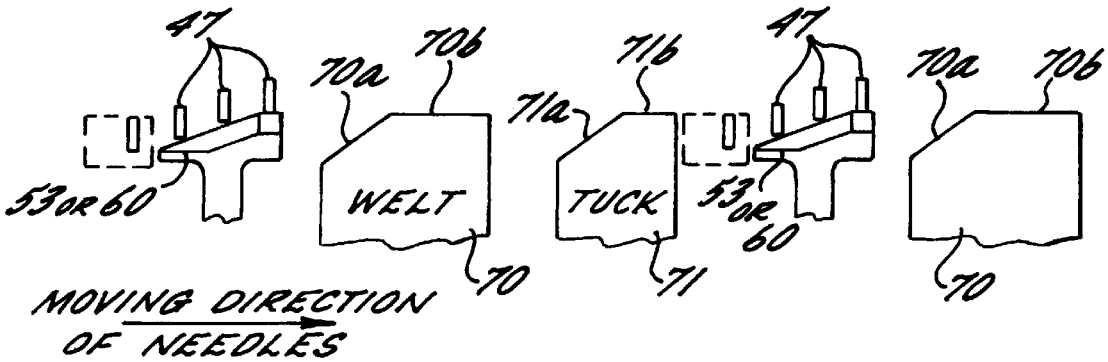
FIG. 13 is a schematic view illustrating the relationship between the finger and the welt and tuck cams to cause the needle to move to the welt and tuck positions.
Figure 14:
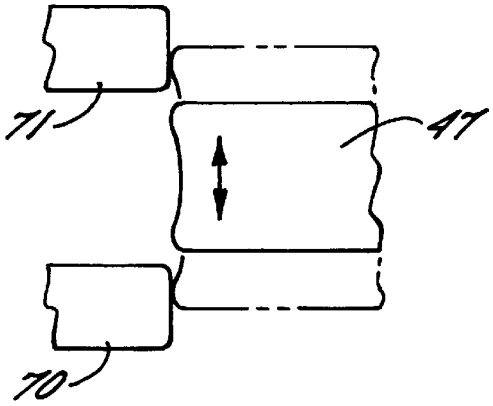
FIG. 14 is a schematic view illustrating the relationship between the master butt of the selector jack and the welt and tuck cams to move the selector jacks to the tuck and welt positions.

A welt cam 70 and a tuck cam 71 are carried either by the lower cam ring 25 of the upper cam ring 24 by suitable supports (not shown). Cam 70 includes an inwardly sloping surface 70*a* and a horizontal surface 70*b* (FIGS. 10 and 13). Cam 71 also has an inwardly sloping surface 71*a* and a horizontal surface 71*b*. As shown in FIG. 14, cams 70 and 71 are mounted at different heights relative to the master butt 47 of the selector jack 40 such that neither of these cams are contacted by the master butt 47 when the piezoelectric body 51 is in the neutral position and cam 70 is contacted by the master butt 47 when the piezoelectric body 51 is displaced downwardly and cam 71 is contacted thereby when the piezoelectric body 50 is displaced upwardly.

Figure 2:
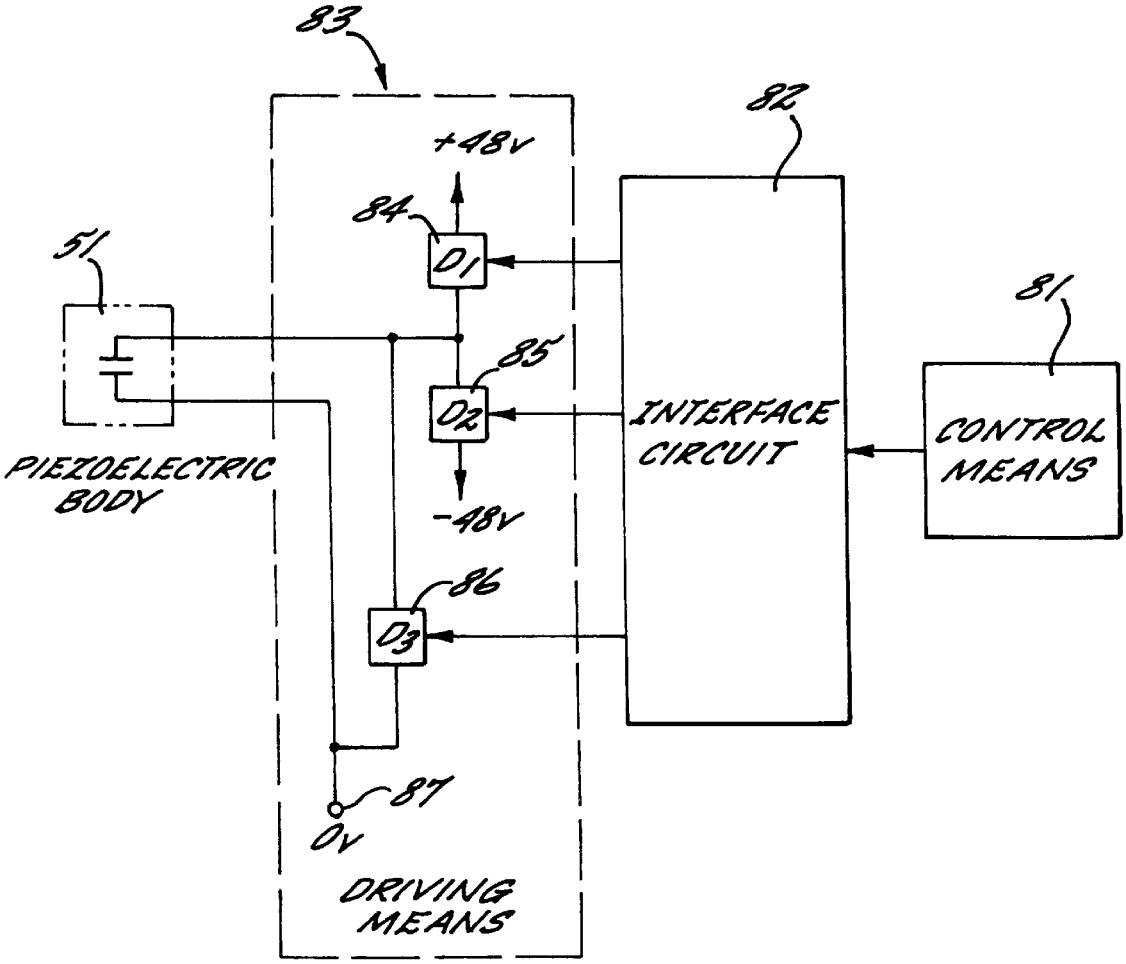
FIG. 2 is a schematic view of control means and driving means for the piezoelectric body of FIG. 1.

Referring now to FIG. 2, there is illustrated schematically a pattern control system, generally indicated at 80, for the piezoelectric body 51. Control system 80 includes a control means 81, an interface circuit 82 and driving means, generally indicated at 83. Driving means 83 includes a first driving or switching means 84 (labeled $D_1$), which may be a first transistor circuit, a second driving or switching means 85 (labeled $D_2$), which may be a second transistor circuit, and a third driving or switching means 86 (labeled $D_3$), which may be a third transistor circuit. The first, second and third switching means 84, 85 and 86 are all connected in parallel to the piezoelectric body 51. In addition, first switching means 84 is connected to a positive voltage of a first potential, for example, +48 volts and second switching means 85 is connected to a negative voltage of a second potential, for example, −48 volts. All three switching means are connected to ground as is indicated at 87.

The control means 81 outputs, for example, three kinds of two-bit information signals, such as "0,0"; "1,0" and "0,1". These output signals are delivered to interface circuit 82 which converts the two-bit information signals to actuating signals for the first, second and third switching means 84, 85 and 86. For example, when information signal "0,0" is output from control means 81 to interface circuit 82, interface circuit 82 outputs an actuating signal to open the first and second switching means 84 and 85 while third switching means 86 is closed and short circuits the piezoelectric body 51. Piezoelectric body 51 is caused to move to the neutral position. When information signal "1,0" is output, interface circuit 82 outputs an actuating signal to open the second and third switching means 85 and 86 while closing the first switching means 84. First switching means 84 then applies a positive voltage of, for example, +48 volts to the piezoelectric element 51*b* which causes the piezoelectric body 51 to be displaced upwardly. Similarly, when information signal "0,1" is output by control means 81, interface circuit 82 outputs an actuating signal to open the first and third switching means 84 and 86 while closing the second switching means 85. Second switching means 85 applies a negative voltage of, for example, −48 volts to piezoelectric element 51*a* to cause piezoelectric body 51 to be displaced downwardly.

Figures 3, 4:
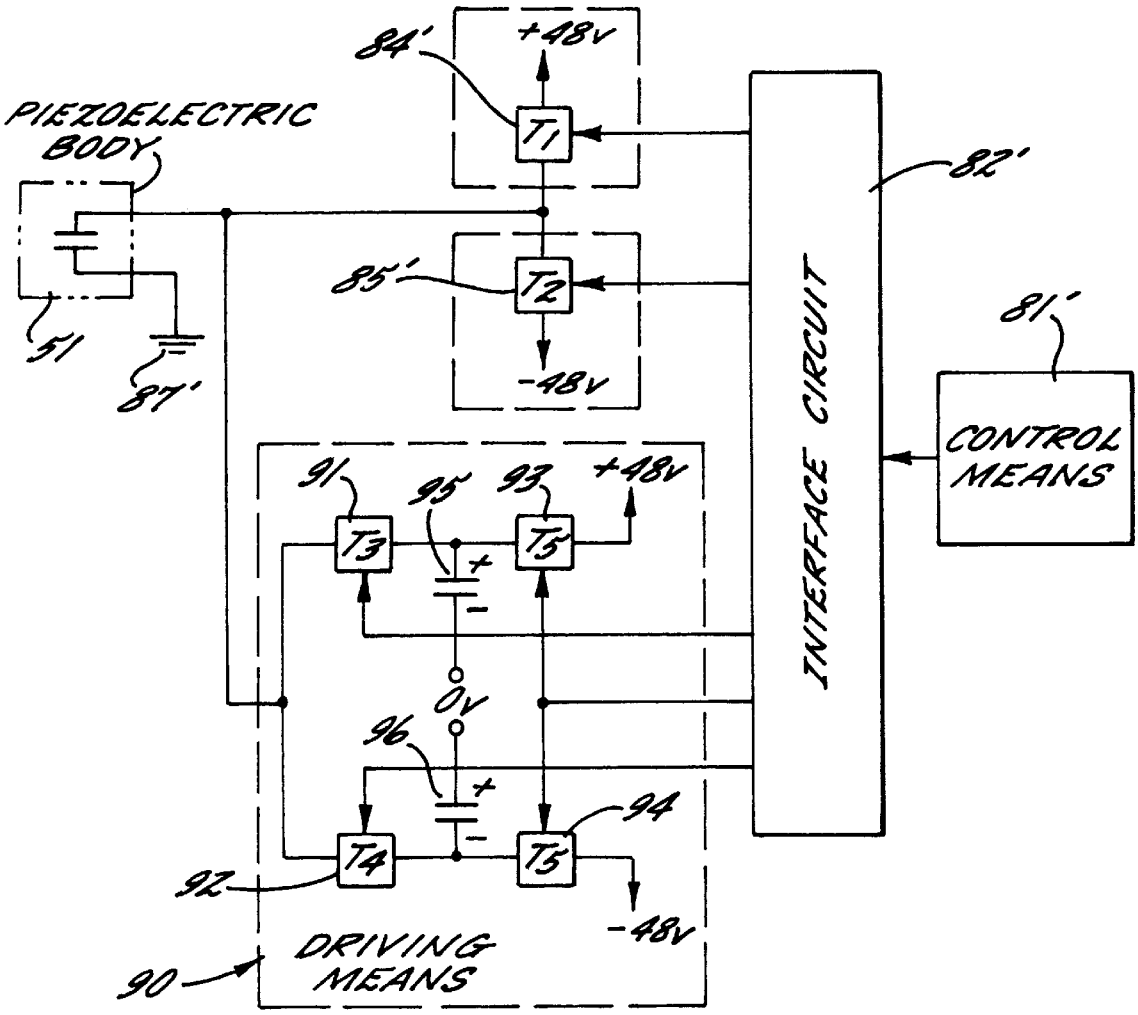
FIG. 3 is a schematic view similar to FIG. 2 of another embodiment of the control means and driving means for the piezoelectric body of FIG. 1.
FIG. 4 is a table of typical output signal states of the driving means of FIG. 3.

Referring now to FIG. 3, there is illustrated another embodiment of a control for the piezoelectric body 51, wherein like reference characters are used to refer to like elements with the prime notation added. A control means 81' is provided and outputs three two-bit information signals to an interface circuit 82'. Interface circuit 82' converts the two-bit information signals to actuating signals and outputs such actuating signals to a first switching means 84' (labeled $T_1$) , a second switching means 85' (labeled $T_2$), and a driving means, generally indicated at 90. Driving means 90 includes first, second, and paired third and fourth switching means 91 (labeled $T_3$), 92 (labeled $T_4$) and 93 (labeled $T_5$) , 94 (also labeled $T_5$). As before, all of these switching means 84', 85', 91, 92 and 93, 94 may be transistor circuits, and all are connected to the piezoelectric body 51 and to ground as indicated at 87'.

Switching means 91 and 93 are connected in series, as are switching means 92, 94. A capacitance means, which may be a pair of capacitors 95, 96 are connected across the series connected switching means 91, 93 and 92, 94.

When control means 81' outputs an information signal "0,0", interface circuit 82' outputs an actuating signal to switch off switching means 84', 85', 93 and 94 and switches the switching means 91 and 92 on and off quickly and alternately. The capacitors 95, 96, which have been precharged, are discharged. As shown in FIG. 6, positive (+) and negative (−) voltages are alternately applied, resulting in a more neutral condition (FIG. 5*a*).

When information signal "1,0" is output by control means 81', interface circuit 82' outputs an actuating signal to switch on the switching means 84' and switch off the switching means 85', 91 and 92. Switching means 93 and 94 are switched on to charge the capacitors 95 and 96. Switching means 84' applies a positive voltage of, for example, +48 volts to piezoelectric body 51 causing the front end thereof to displace downwardly (FIG. 5*c*).

When control means 81' outputs the information signal "0,1", interface circuit 82' outputs an actuating signal to switch on the switching means 85' and switch off the switching means 84', 91 and 92 and to switch on the switching means 93, 94 to charge the capacitors 95, 96. Switching means 85' applies a negative voltage of, for example, −48 volts to piezoelectric body 51 to cause the front end thereof to displace upwardly (FIG. 5*b*). FIG. 4 is a table which correlates the three operational positions of the piezoelectric body 51 and the operating conditions of the transistor circuits or switching means 84', 85', 91, 92, 93 and 94 (labeled $T_1$, $T_2$, $T_3$, $T_4$ and $T_5$, $T_5$).

The operation of the apparatus of the present invention will now be described. A pre-programmed pattern device (not shown) causes the control means 81 or 81' to output the requisite two-bit information signals to cause the piezoelectric body 51 to occupy a particular position of its three operating positions to achieve a corresponding movement of the knitting needle 22 to the knit, tuck or welt position as is necessary to duplicate the pattern to be knit. If the pattern calls for the needle 22 to be moved to the knit position, the piezoelectric body 51 is caused to move to the neutral position (FIG. 5*a*) in a manner previously described.

The selector jack 40 is not raised or lowered but the pattern butt 48 thereof engages and moves along the front face 54 or 61 of the finger 53 or 60 which pivots the selector jack 40 inwardly. The master butt 47 of the selector jack 40 passes between the cams 70 and 71 and the spring jack 30 is raised by cams 32 to raise needle 22. Needle 22 is then raised by stitch cam 26 to the knit position.

If the pattern calls for the needle 22 to be raised to the tuck position, the piezoelectric body 51 is caused to move downwardly (FIG. 5*c*) so that pattern butt 48 on the selector jack 40 engages and moves along upper face 55 or 62 of actuating head 53 or 60 to raise selector jack 40 upwardly and to cause master butt 47 to engage the tuck cam 71. Tuck cam 71 moves selector jack 40 inwardly and causes spring jack 30 to be moved by cam 32 to the tuck position and correspondingly to cause needle 22 to be moved to the tuck position by stitch cam 26.

Needle 22 is moved to the welt position by piezoelectric body 51 moving upwardly which causes pattern butt 48 to engage and move along the lower face 56 or 63 of head 53 or 60 to move the selector jack 40 downwardly. Welt cam 70 will then force selector jack 40 inwardly which will cause spring jack 30 to engage the welt cam track of cam 32 and thus needle 22 to engage the welt cam track of stitch cam 26.

In this manner, needle selection in accordance with a preprogrammed or predetermined pattern is accomplished using piezoelectric elements with only half of the usual number of fingers and actuating heads.

In the drawings and specifications, there has been set forth a preferred embodiment of the invention, and although specific terms are employed, they are used in a generic and descriptive sense only and not for purposes of limitation, the scope of the invention being set forth in the following claims.

I claim:

1. In a knitting machine including knitting needles movable between knit, tuck and welt positions to form stitch loops in a predetermined pattern, the combination of pattern controlled needle selection means for selecting particular needles to be moved to and between the knit, tuck and welt position in accordance with said pattern, said needle selection means including a piezoelectric electric body movable between three operative positions corresponding to the knit, tuck and welt positions of said needles, first driving means for causing said piezoelectric body to move to one of its operative positions, second driving means for causing said piezoelectric body to move to another one of its operative positions, and third driving means for causing said piezoelectric body to move to the remaining one of its operative positions, whereby said piezoelectric body selects and causes the needles to move between their three operative positions in accordance with said predetermined pattern.

2. A knitting machine according to claim 1 wherein said needle selection means includes control means for outputting three control signals to control said first, second and third driving means.

3. A knitting machine according to claim 1 wherein said piezoelectric body comprises an elongate base member and at least one piezoelectric element carried by said base member and movable to a first position upon application of a voltage of a first potential, movable to a second position upon application of a voltage of a second potential different from said first potential and movable to a third position upon application of a voltage of a third potential intermediate the first and second potential.

4. A knitting machine according to claim 3 wherein said first and second potentials are voltages of equal value but opposite polarity.

5. A knitting machine according to claim 4 wherein said third potential is zero.

6. A knitting machine according to claim 4 wherein said third potential comprises outputs of opposite polarity of two capacitors applied quickly and alternately until said capacitors are discharged to zero.

7. In a knitting machine having knitting needles movable between knit, tuck and welt positions, spring jacks operatively associated with said knitting needles for moving said knitting needles between their operative and inoperative positions, and selector jacks for selectively activating said spring jacks to move said needles, the combination of a piezoelectric body movable between positions corresponding to said operative and inoperative positions of said needles, selector jack actuating means carried by said piezoelectric body and movable therewith, said actuating means selectively engaging and moving said selector jacks inwardly to cause said needles to move to the knit position and upwardly and downwardly to cause said needles to move to the welt and tuck positions responsive to the positions of said piezoelectric body, first driving means for causing said piezoelectric body to move to at least one position corresponding to said operative position of said needles, and second driving means for causing said piezoelectric body to move to another position corresponding to said inoperative position of said needles.

8. A knitting machine according to claim 7 wherein said selector jacks include a master butt and a pattern butt thereon in longitudinal spaced relation and said actuating means comprises an actuating head including a front cam face, an upper cam face and a lower cam face adapted to engage said pattern butt on said selector jack to move said selector jack.

9. A knitting machine according to claim 8 wherein said front cam face of said actuating head has an inwardly sloping surface and a horizontal surface, said upper cam face has an upwardly sloping surface and a horizontal surface, and said lower cam face has a downwardly sloping surface and a horizontal surface.

10. A knitting machine according to claim 8 wherein said front cam face of said actuating head has an inwardly sloping surface and an outwardly sloping surface, said upper cam face has an upwardly sloping surface and a horizontal surface and said lower cam face has a downwardly sloping surface and a horizontal surface.

11. A knitting machine according to claim 10 wherein said upwardly sloping surface on said upper cam face has a first upwardly sloping surface and a second upwardly sloping surface of a different inclination from said first sloping surface and said downwardly sloping surface of said lower cam face has a first downwardly sloping surface and a second downwardly sloping surface of a different inclination from said first downwardly sloping surface.

12. A knitting machine according to claim 8 including a cancelling cam engageable with said master butts on said selector jacks for returning all of said selector jacks to the same position or level as said selector jacks approach said actuating means.

13. A knitting machine according to claim 8 including a welt cam engageable with said master butts on said selector jacks when said selector jacks are moved downwardly by said actuating means for moving said selector jacks to a position corresponding to the welt position of said needles, and a tuck cam engageable with said master butts on said selector jacks when said selector jacks are moved upwardly by said actuating means for moving said selector jacks to a position corresponding to the tuck position of said needles.

14. A knitting machine according to claim 13 wherein each of said selector jacks has a lateral projection at its lower end, and including selector jack support means engageable with said projections to maintain said selector jacks at a certain level when said selector jacks are moved inwardly by said actuating means and to assist in moving said selector jacks upwardly and downwardly to maintain said selector jacks in stable positions.

15. A knitting machine according to claim 8 wherein said selector jacks are resilient in a medial, stem portion thereof.

16. A control apparatus useable as a selection mechanism comprising a piezoelectric body movable between three operative positions, said piezoelectric body comprising an elongate, relatively thin base member, a first piezoelectric element mounted on one side of said base member and a second piezoelectric element mounted on the opposite side of said base member from said first piezoelectric element, first driving means for displacing said piezoelectric body to a first position, second driving means for displacing said piezoelectric body to a second position, third driving means for displacing said piezoelectric body to a third position, and control means for controlling said first, second and third driving means in accordance with a preset pattern or program.

17. A control apparatus according to claim 16 wherein said piezoelectric body is mounted for movement between upper, lower and neutral operative positions.

18. A control apparatus according to claim 17 wherein said first driving means comprises a first transistor circuit for applying a voltage of a first potential to said first piezoelectric element to cause said first piezoelectric element to displace said piezoelectric body upwardly, and said second driving means comprises a second transistor circuit for applying a voltage of a second potential to said second piezoelectric element to cause said second piezoelectric element to displace said piezoelectric body downwardly.

19. A control apparatus according to claim 18 wherein said third driving means comprises a third transistor circuit for applying to said first and second piezoelectric elements a voltage of a third potential between said first and second potentials to cause said piezoelectric elements to displace said piezoelectric body to the neutral position.

20. A control apparatus according to claim 19 wherein said third transistor circuit applies a third potential of zero to said first and second piezoelectric elements.

21. A control apparatus according to claim 19 wherein a third potential comprises outputs of opposite polarity of two capacitors applied quickly and alternately until said capacitors are discharged to zero.

* * * * *